US008136924B2

(12) United States Patent
Owaki

(10) Patent No.: US 8,136,924 B2
(45) Date of Patent: Mar. 20, 2012

(54) LIQUID EJECTING HEAD UNIT AND LIQUID EJECTING APPARATUS

(75) Inventor: Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 324 days.

(21) Appl. No.: 12/577,989

(22) Filed: Oct. 13, 2009

(65) Prior Publication Data

US 2010/0091071 A1 Apr. 15, 2010

(30) Foreign Application Priority Data

Oct. 15, 2008 (JP) ..... 2008-266031
Jul. 22, 2009 (JP) ..... 2009-170877

(51) Int. Cl.
*B41J 2/14* (2006.01)

(52) U.S. Cl. ..... 347/50

(58) Field of Classification Search ..... 347/50, 347/55–59
See application file for complete search history.

(56) References Cited

U.S. PATENT DOCUMENTS 7,055,936 B2 * 6/2006 Imai et al. ..... 347/58
7,871,152 B2 * 1/2011 Suzuki et al. ..... 347/50

FOREIGN PATENT DOCUMENTS

| | | |
|---|---|---|
| JP | 2001-096753 | 4/2001 |
| JP | 2001-277486 | 10/2001 |
| JP | 2003-053968 | 2/2003 |
| JP | 2004-136648 | 5/2004 |
| JP | 2004-148813 | 5/2004 |
| JP | 2007-137054 | 6/2007 |
| JP | 2007-269012 | 10/2007 |

* cited by examiner

*Primary Examiner* — Lamson Nguyen
(74) *Attorney, Agent, or Firm* — Workman Nydegger

(57) ABSTRACT

A liquid ejecting head unit includes a liquid ejecting head that ejects a liquid, a first holding member that holds the liquid ejecting head, and a second holding member positioned on the first holding member. The liquid ejecting head includes a nozzle face having a nozzle opening for ejecting the liquid and a flexible first wiring substrate having that can be erected in a direction perpendicular to the nozzle face. The first holding member has a wiring substrate inserting hole that contains the first wiring substrate, and is held by the second holding member on a side opposite to the liquid ejecting head. The first wiring substrate of the liquid ejecting head and a connection member electrically connected to a second wiring substrate are electrically connected to each other on the first holding member side of the second holding member.

6 Claims, 9 Drawing Sheets

LIQUID EJECTING HEAD UNIT AND LIQUID EJECTING APPARATUS

BACKGROUND

1. Technical Field

The present invention relates to a liquid ejecting head unit and a liquid ejecting apparatus that includes a holding member that holds a liquid ejecting head and a wiring substrate.

2. Related Art

As a representative example of a liquid ejecting head that discharges liquid droplets, there is an ink jet recording head that discharges ink droplets. As such ink jet recording head, for example, an ink jet recording head that includes a flow path forming substrate, in which a pressure generating chamber communicated with a nozzle opening and a communication portion communicated with the pressure generating chamber are formed, a piezoelectric element that is formed on one face side of the flow path forming substrate, and a protection substrate that has a piezoelectric element holding portion that is bonded to a piezoelectric element side of the flow path forming substrate and is used for holding the piezoelectric element has been known. Here, on the protection substrate, an IC that is a driving circuit used for driving the piezoelectric element is placed. In addition, the driving circuit and the piezoelectric element are connected through a lead electrode, which is led out from one electrode of the piezoelectric element, with a connection wiring that is formed of a conductive wire by using a wire bonding method (for example, see JP-A-2004-148813).

In addition an ink jet recording head unit including a case member in which an ink jet recording head is mounted and a wiring substrate electrically connected to the ink jet recording head is held, has been proposed (for example, see JP-A-2007-269012).

However, for example, when a pressure generating element of the ink jet recording head and the wiring substrate that is disposed in the case member serving as a holding member are directly connected together by using a connection substrate such as an FPC, the size of the device is increased due to handling of the connection substrate.

In addition, such a problem is not limited to an ink jet recording head unit that includes an ink jet recording head and exists also in a liquid ejecting head unit that ejects a liquid other than ink.

SUMMARY

An advantage of some aspects of the invention is that it provides a liquid ejecting head unit and a liquid ejecting apparatus that can be miniaturized.

According to a first aspect of the invention, there is provided a liquid ejecting head unit including: a liquid ejecting head that ejects a liquid; a first holding member that holds the liquid ejecting head; and a second holding member that is disposed on the first holding member. The liquid ejecting head includes: a nozzle face on which a nozzle opening for ejecting the liquid is disposed; and a first wiring substrate having flexibility that is disposed to be erected in a direction perpendicular to the nozzle face. The first holding member has a wiring substrate inserting hole in which the first wiring substrate is disposed, holds the liquid ejecting head on one face side on which the wiring substrate inserting hole is opened, and is held by the second holding member on a side opposite to the liquid ejecting head, and on a side opposite to the liquid ejecting head in the wiring substrate inserting hole, the first wiring substrate of the liquid ejecting head and a connection member that is electrically connected to a second wiring substrate are electrically connected to each other on the first holding member side of the second holding member.

According to the above-described liquid ejecting head unit, the wiring substrate is erected. Accordingly, the liquid ejecting head unit can be configured to have high density so as to be miniaturized.

In the above-described liquid ejecting head unit, it may be configured that the second wiring substrate is disposed in the second holding member, and the second holding member includes a protection member that is used for protecting the second wiring substrate. In such a case, the second wiring substrate can be protected from liquid, dust, and the like.

In addition, in the above-described liquid ejecting head unit, a plurality of the liquid ejecting heads may be configured to be held in the first holding member. In such a case, the number of rows of the nozzles can be increased, and the nozzles can be disposed at high density by using the plurality of liquid ejecting heads. In addition, the manufacturing cost can be reduced, compared to a case where high density is implemented by using one recording head.

In addition, in the above-described liquid ejecting head unit, the first wiring substrate of each of the plurality of the liquid ejecting heads may be configured to be connected to the common connection member. In such a case, the manufacturing cost can be reduced by decreasing the number of components, and the head unit can be miniaturized.

In addition, in the above-described liquid ejecting head unit, a connection space in which the first wiring substrate and the connection member are connected together may be configured to be sealed on the side of the liquid ejecting head. In such a case, the connection member and the connection portion of the first wiring substrate, and the like can be protected from liquid, dust, and the like.

According to a second aspect of the invention, there is provided a liquid ejecting apparatus including the above-described liquid ejecting head unit.

According to this aspect, a liquid ejecting apparatus that is miniaturized and of a low manufacture cost can be implemented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail.

Embodiment 1

Figure 1:
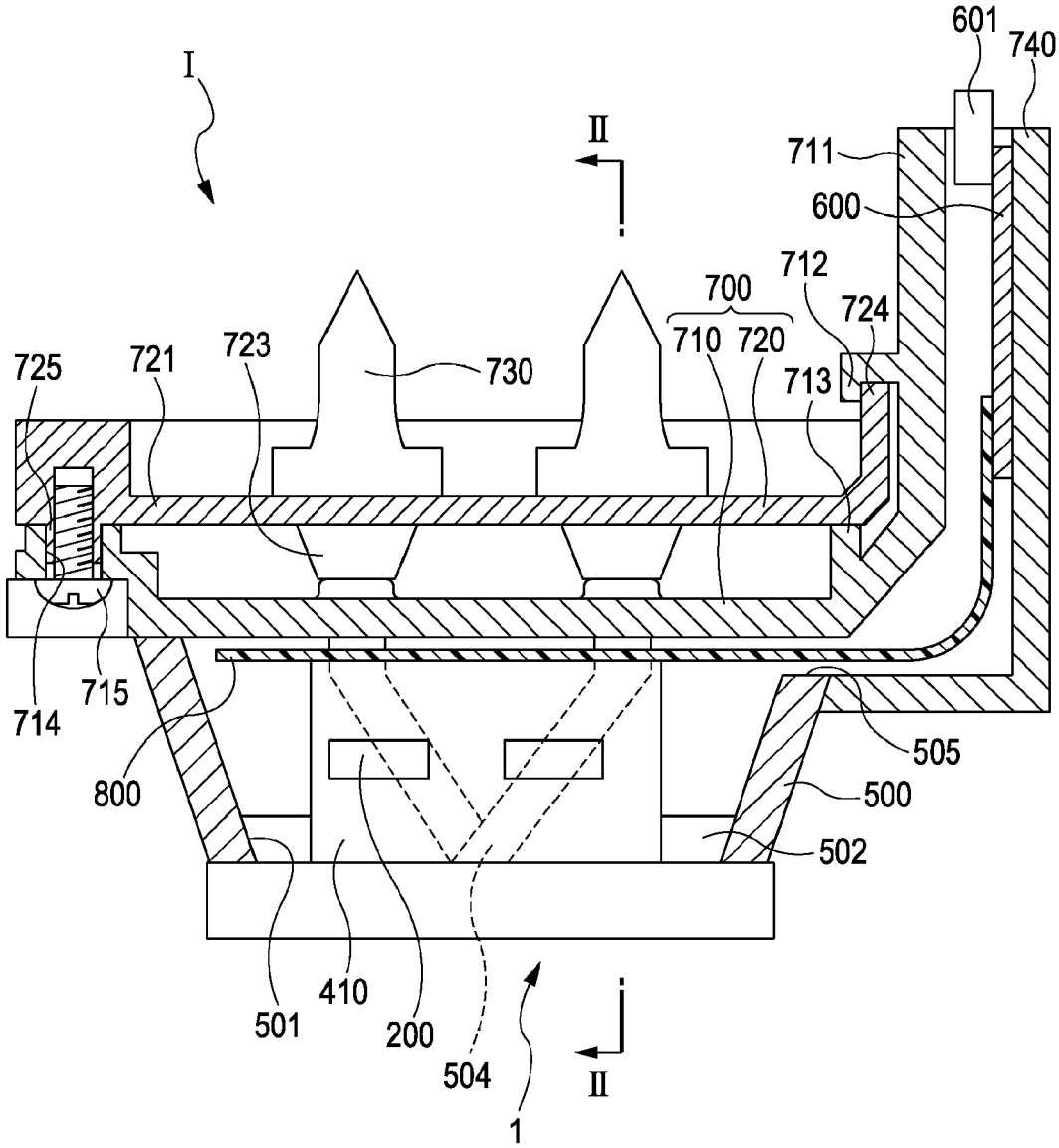
FIG. 1 is a cross-sectional view of a head unit according to Embodiment 1 of the invention.
Figure 2:
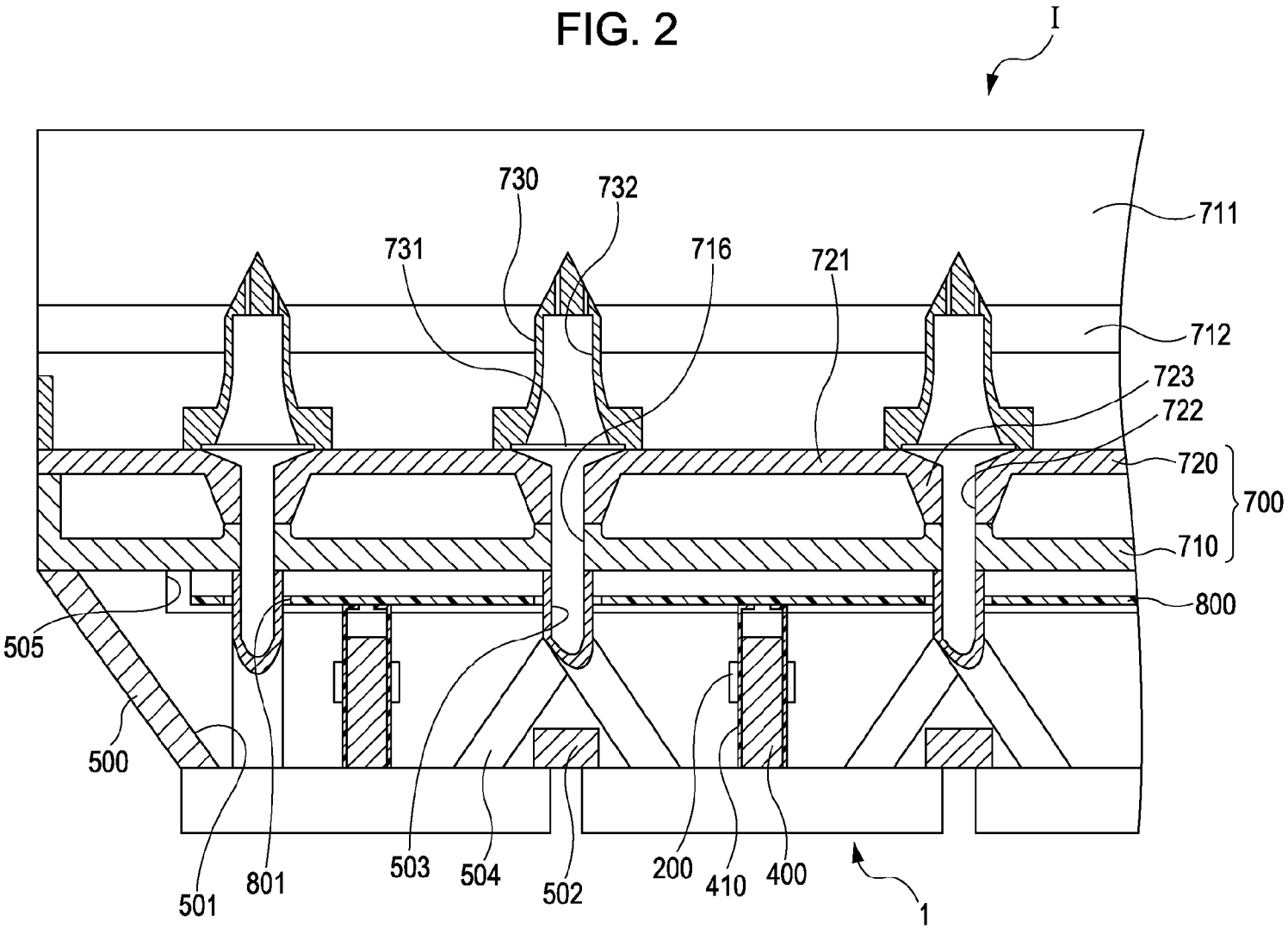
FIG. 2 is a cross-sectional view of a head unit according to Embodiment 1.

FIG. 1 is a cross-sectional view of an ink jet recording head as an example of a liquid ejecting head unit according to Embodiment 1 of the invention. FIG. 2 is a cross-sectional view taken along line II-II shown in FIG. 1.

As shown in the figure, the ink jet recording head unit I (hereinafter, also referred to as a head unit I) includes a plurality of ink jet recording heads 1 (hereinafter, also referred to as a recording head 1), a first holding member 500 that holds the recording heads 1, a second holding member 700 that is bonded to the first holding member 500 and holds a second wiring substrate 600, and a connection member 800 that electrically connects the second wiring substrate 600 and the recording head 1 to each other.

Figure 3:
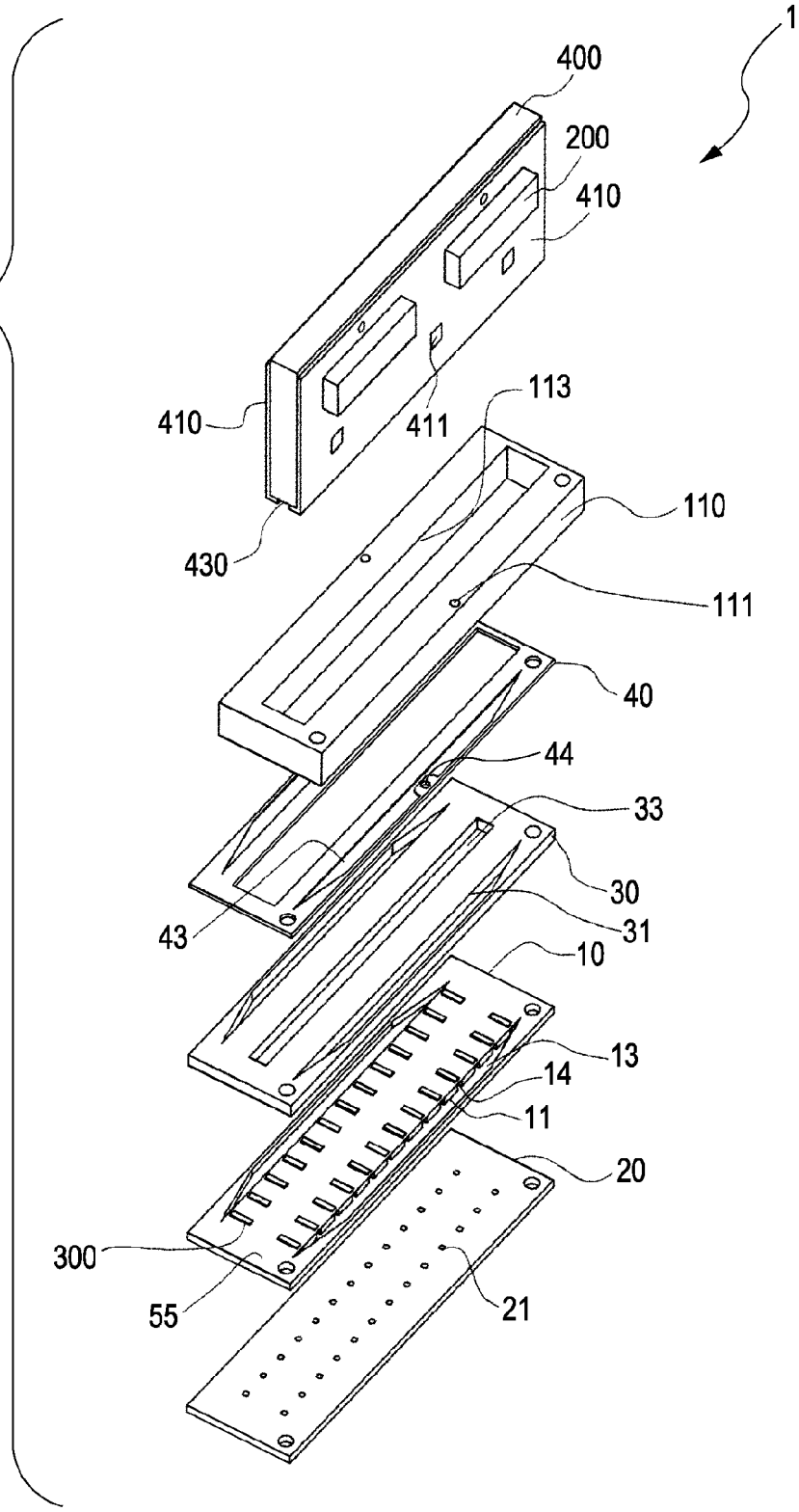
FIG. 3 is an exploded perspective view of a recording head according to Embodiment 1.
Figure 4:
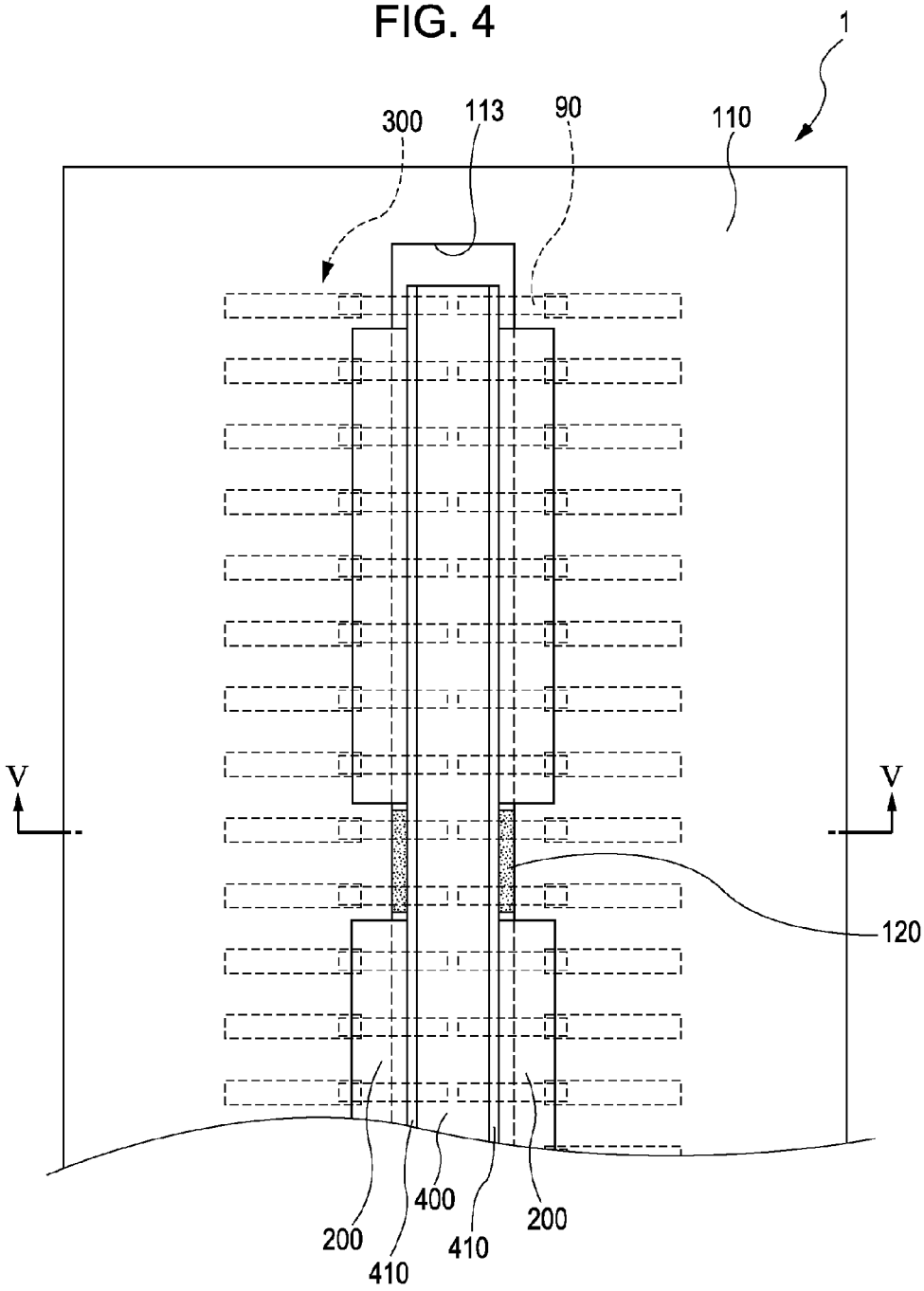
FIG. 4 is a plan view of a recording head according to Embodiment 1.
Figure 5:
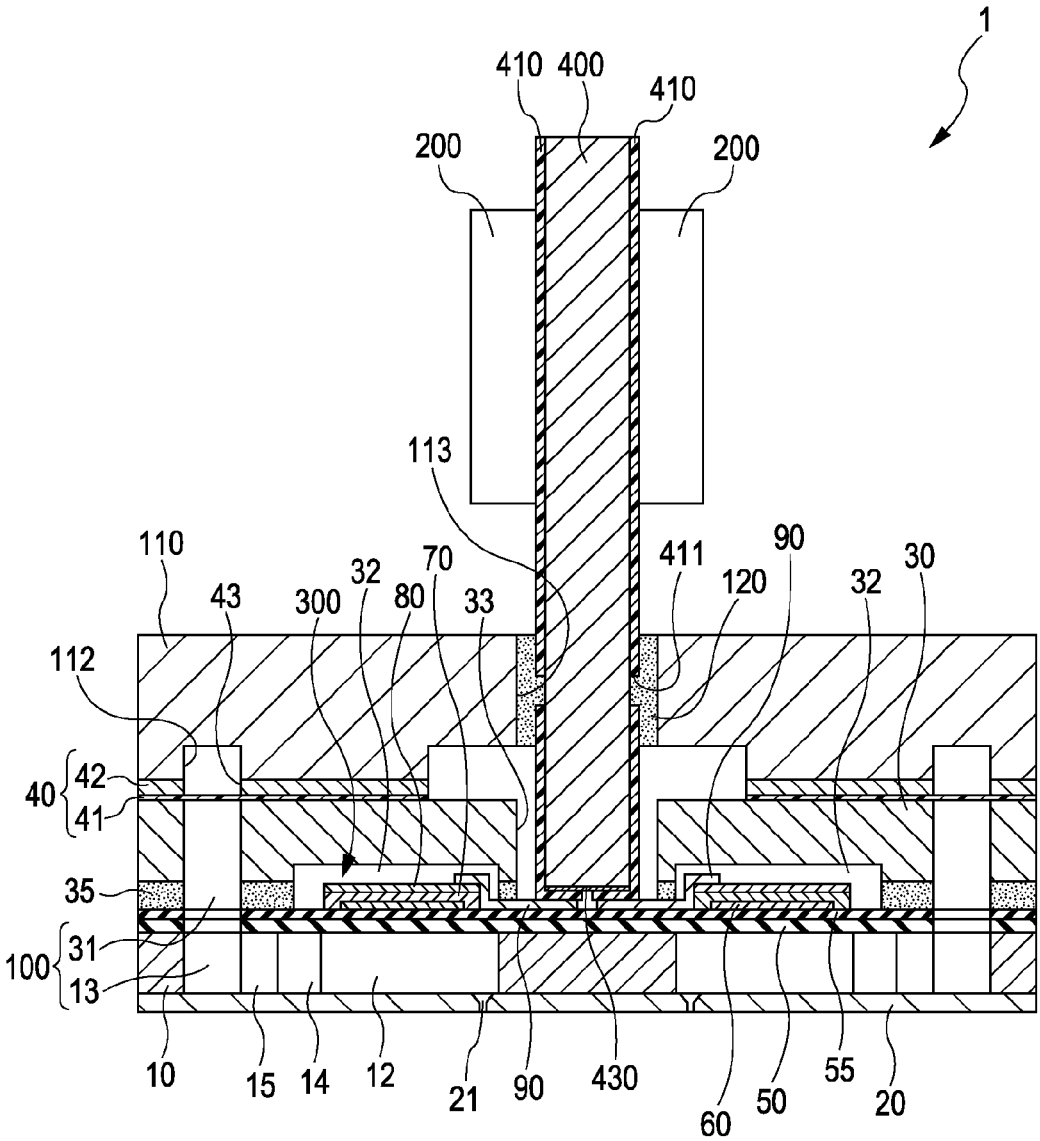
FIG. 5 is a cross-sectional view of a recording head according to Embodiment 1.

First, the recording head 1 will be described in detail with reference to FIGS. 3 to 5. FIG. 3 is an exploded perspective view of a recording head according to Embodiment 1 of the invention. FIG. 4 is a plan view of the recording head, and FIG. 5 is a cross-sectional view taken along line V-V shown in FIG. 4.

As shown in the above-described figures, a flow path forming substrate 10 according to this embodiment is formed of a silicon monocrystal substrate having the plane orientation of (110). On one face of the flow path forming substrate 10, an elastic film 50 that is made of silicon dioxide is formed.

In the flow path forming substrate 10, each pair of rows are formed by arranging a plurality of pressure generating chambers 12 partitioned by a partition wall 11 in the widthwise direction parallel to each other. In addition, in an outer area of the pressure generating chambers 12 of each row in the longitudinal direction, a communication portion 13 is formed, and the communication portion 13 and each pressure generating chamber 12 are communicated with each other through an ink supplying path 14 and a communication path 15 that are disposed for each pressure generating chamber 12. The communication portion 13 is communicated with a reservoir portion 31 of a protection substrate 30 to be described later and configures a part of a reservoir 100 that becomes a common ink chamber for each row of the pressure generating chambers 12. The ink supplying path 14 is formed to have a narrower width than that of the pressure generating chamber 12 and maintains flow path resistance of ink flowing into the pressure generating chamber 12 from the communication portion 13 to be constant. In addition, according to this embodiment, the ink supplying path 14 is formed by constricting the width of the flow path from one side. However, the ink supplying path may be formed by constricting the width of the flow path from both sides. In addition, the ink supplying path may be formed by constricting the flow path in the thickness direction, instead of constricting the flow path in widthwise direction. In addition, each communication path 15 is formed by partitioning a space between the ink supplying path 14 and the communication portion 13 by extending the partition walls 11 located on both sides of the pressure generating chambers 12 to the communication portion 13 sides in the widthwise direction. In other words, in the flow path forming substrate 10, the ink supplying path 14 having a cross-sectional area smaller than that of the pressure generating chamber 12 in the widthwise direction and the communication path 15 that is communicated with the ink supplying path 14 and has a cross-sectional area larger than that of the ink supplying path 14 in the widthwise direction are disposed by being partitioned by a plurality of the partition walls 11.

In addition, on the opening face side of the flow path forming substrate 10, a nozzle plate 20, in which nozzle openings 21 that are communicated with areas near end portions of the pressure generating chambers 12 that are located on a side opposite to the ink supplying path 14 are is formed, is fixed by using an adhesive agent, a heat-welding film, or the like. In this embodiment, two rows in which the pressure generating chambers 12 are arranged are disposed on the flow path forming substrate 10. Accordingly, in one recording head 1 two nozzle rows, in which the nozzle openings 21 are arranged, are disposed. The nozzle plate 20, for example, is formed of glass ceramics, a single-crystal silicon substrate, or stainless steel.

On the other hand, on a side of the flow path forming substrate 10 that is located opposite to the opening face, as described above, the elastic film 50 is formed. In addition, an insulation film 55 is formed on the elastic film 50. In addition, on the insulation film 55, a first electrode 60, a piezoelectric body layer 70, and a second electrode 80 are laminated to be formed so as to configure a piezoelectric element 300 that is a pressure generating element according to this embodiment. Here, the piezoelectric element 300 represents a portion that includes the first electrode 60, the piezoelectric body layer 70, and the second electrode 80. Generally, any one electrode of the piezoelectric element 300 is used as a common electrode, and the other electrode and the piezoelectric body layer 70 are patterned for each pressure generating chamber 12. Here, a portion that is configured by the patterned electrode and the patterned piezoelectric body layer 70 and has piezoelectric distortion by applying a voltage to both electrodes is called as an active piezoelectric body part. In this embodiment, the first electrode 60 located on the flow path forming substrate 10 side is configured as the common electrode of the piezoelectric element 300, and the second electrode 80 is configured as an individual electrode of the piezoelectric element 300. However, these may be oppositely configured depending on the situation of the driving circuit and wirings. In addition, here, the piezoelectric element 300 and a vibration plate that is displaced in accordance with the driving of the piezoelectric element 300 are collectively referred to as an actuator device. In addition, in the above-described example, the elastic film 50, the insulation film 55, and the first electrode 60 serves as a vibration plate. However, the invention is not limited thereto. For example, a configuration in which only the first electrode 60 serves as a vibration plate without disposing the elastic film 50 and the insulation film 55 may be used. Alternatively, the piezoelectric element 300 may be configured so as to substantially serve as the vibration plate as well.

The piezoelectric body layer 70 is formed of a piezoelectric material, which exhibits electromechanical energy converting reaction occurring on the first electrode 60, and more particularly, a ferroelectric material, which has a perovskite structure, among piezoelectric materials. It is preferable that a crystal film having a perovskite structure is used for the piezoelectric body layer 70. For example, a ferroelectric material such as lead zirconium titanate (PZT), or the ferroelectric material to which metal oxide such as niobium oxide, nickel oxide, or magnesium oxide is added may be appropriately used for the piezoelectric body layer 70.

In addition, to the second electrode 80 that is an individual electrode of the piezoelectric element 300, a lead electrode 90 that extends to an area located on the insulation film 55 and is, for example, formed of gold (Au) is connected. One end portion of the lead electrode 90 is connected to the second electrode 80, and the other end portion of the lead electrode 90 extends to be installed between the rows in which the piezoelectric elements 300 are arranged.

On the flow path forming substrate 10, in which the piezoelectric elements 300 are formed, that is, on the first electrode 60, the insulation film 55, and the lead electrode 90, the protection substrate 30 having the reservoir portion 31 that configures at least a part of the reservoir 100 is bonded through an adhesive agent 35. This reservoir portion 31, according to this embodiment, is formed to extend in the widthwise direction of the pressure generating chamber 12 by perforating the protection substrate 30 in the thickness direction. Thus, as described above, the reservoir portion 31 is communicated with the communication portion 13 of the flow path forming substrate 10 and configures the reservoir 100 that becomes the common ink chamber of the pressure generating chambers 12. In addition, in this embodiment, the communication portion 13 that becomes the reservoir 100 is disposed on the flow path forming substrate 10. However, the invention is not particularly limited thereto. For example, the communication portion 13 of the flow path forming substrate 10 may be divided into a plurality of parts for each pressure generating chamber 12, and only the reservoir portion 31 may be configured as the reservoir. Alternatively, for example, only the pressure generating chamber 12 is disposed on the flow path forming substrate 10, and an ink supplying path 14 that allows the reservoir and each pressure generating chamber 12 to be communicated with each other may be disposed in a member (for example, the elastic film 50, the insulation film 55, or the like) that is interposed between the flow path forming substrate 10 and the protection substrate 30.

In addition, in each area of the protection substrate 30 that faces the piezoelectric elements 300, a piezoelectric element holding portion 32 that is a holding portion having a space sufficient for not blocking the movement of the piezoelectric elements 300 is disposed. The piezoelectric element holding portion 32 is configured to have a space sufficient for not blocking the movement of the piezoelectric elements 300. The space may be sealed or may not be sealed. In addition, according to this embodiment, two rows in which the piezoelectric elements 300 are arranged are disposed, and accordingly, the piezoelectric element holding parts 32 are disposed in correspondence with each arranged row in which the piezoelectric elements 300 are arranged. In other words, in the protection substrate 30, two piezoelectric element holding parts 32 are disposed in the arrangement direction of the rows in which the piezoelectric elements 300 are arranged.

As the protection substrate 30, it is preferable that a material such as a glass material or a ceramic material that approximately has a same coefficient of thermal expansion as that of the flow path forming substrate 10 is used. In this embodiment, a single-crystal silicon substrate that is the same as the material of the flow path forming substrate 10 is used for forming the protection substrate 30.

In addition, in the protection substrate 30, a through hole 33 that is formed by perforating the protection substrate 30 in the thickness direction is disposed. The through hole 33, in this embodiment, is disposed between the two piezoelectric element holding parts 32. In addition, a portion of the lead electrode 90 near an end thereof that is led out from each piezoelectric element 300 is disposed so as to be exposed inside the through hole 33.

A driving circuit 200 that is used for driving the piezoelectric element 300 is mounted on a COF substrate 410 that is a first wiring substrate having flexibility. Here, the COF substrate 410 has a lower end portion connected to the lead electrode 90 and is set up approximately vertical.

Thus, the COF substrate 410 is bonded to the side face of a plate-shaped support member 400. In other words, the support member 400 is a rectangular parallelepiped having both side faces to be vertical faces. According to this embodiment, the wiring substrate is configured by the support member 400, the COF substrate 410, and the driving circuit 200.

Described in more detail, in the recording head 1 according to this embodiment, two rows in which the pressure generating chambers 12 are arranged are disposed in the flow path forming substrate 10, and accordingly, two rows in which the piezoelectric elements 300 are arranged in the widthwise direction of the pressure generating chamber 12 (the widthwise direction of the piezoelectric element 300) are disposed. In other words, two rows of the pressure generating chambers 12, two rows of the piezoelectric elements 300, and two rows of the lead electrodes 90 are disposed to face one another. To both sides of the support member 400 having a lower portion inserted into the through hole 33, the COF substrates 410 are bonded. Thus, each COF substrates 410 has a lower portion connected to the end portions of the lead electrodes 90 of each row of the piezoelectric elements 300 and the first electrode 60 and is set up approximately vertical. According to this embodiment, by disposing one COF substrate 410 on each side face of the support member 400, a total of two COF substrates 410 are disposed in one support member 400.

In addition, when being erected alone, the COF substrate 410 that is a wired substrate having flexibility can be easily bent. Accordingly, by bonding the COF substrate 410 to the support member 400 that is a rigid member serving as a brace member, the COF substrate 410 can be erected by suppressing bending thereof. Alternatively, only the COF substrate 410 may be arranged to erect in a direction perpendicular to the face of the flow path forming substrate 10 on which the piezoelectric elements 300 are arranged without disposing the support member 400. In addition, the COF substrate 410 is configured to be bonded to the side face of the support member 400. However, the configuration is not limited thereto. Thus, for example, the COF substrate 410 may be held to be fallen so as to be hooked with the support member 400.

In addition, as shown in FIG. 3, between the lower end face of the support member 400 and the lower end portion of the COF substrate 410, a buffer member 430 that can be appropriately formed from Teflon (a registered trademark) or the like is disposed. In addition, the lower end portion of the COF substrate 410 and the lead electrode 90 are electrically connected by using conductive particles (for example, those contained in an anisotropic conductive material such as an anisotropic conductive film (ACF) or anisotropic conductive paste (ACP)). In other words, by pressing the support member 400 down, the COF substrate 410 is pressed to the lead electrode 90 side through the lower end face thereof. Accordingly, the predetermined electrical connection between the COF substrate 410 and the lead electrode 90 is made by smashing the conductive particles. At this moment, the buffer member 430 serves to allow the pressure on the COF substrate 410 to be uniform. Here, it is preferable that the lower end face of the support member 400 and the lower end portion of the COF substrate 410 or the lower end face of the support member 400 that is brought into contact with the buffer member 430 is configured to have surface precision within five times the particle diameter of the conductive particle. The reason is that, in such a case, through existence of the buffer member 430 and the lower end portion of the COF substrate 410, the pressure applied to the conductive particles can be uniform, and whereby excellent electrical connection can be acquired by smashing the conductive particles. Here, the connection between the lower end portion of the COF substrate 410 and the lead electrode 90 is not limited to the case where the conductive particles are used. Thus, for example, the lower end portion of the COF substrate 410 and the lead electrode 90 may be connected to each other by melting a metal material such as solder.

In addition, it is preferable that the support member 400 has such thermal conductivity that allows the support member 400 to dissipate heat for having the temperature of the driving circuit 200 to be lower than the junction temperature even for a case where the recording head 1 is used at the maximum warranty temperature. In such a case, even when the driving circuit 200 operates under the most severe load condition, sufficient heat dissipation is exhibited, and accordingly, stable driving of the driving circuit for a long time can be achieved. Accordingly, the support member 400 according to this embodiment is formed from SUS as a material thereof. In such a case, the support member 400 allows heat generated by the driving circuit 200 to be absorbed in ink circulating the inside of the driving circuit 200 through the flow path forming substrate 10. As a result, the heat generated by the driving circuit 200 can be dissipated effectively. Similar effects can be acquired by configuring a distance between the surface of the flow path forming substrate 10 and the driving circuit 200 to be sufficiently short even for a case where a metal material such as SUS is not used. In other words, the distance between the driving circuit 200 and the flow path forming substrate 10 may configured to be a distance in which heat is dissipated such that the temperature of the driving circuit 200 is lower than the junction temperature even for a case where the recording head 1 is used at the maximum warranty temperature.

In addition, it is preferable that the support member 400 is formed of a material that has a linear expansion coefficient equivalent to that of a head case 110 that is a holding member to be described later in detail. For example, stainless steel, silicon, or the like may be used as the material for the support member 400.

In addition, as shown in FIG. 3, on the protection substrate 30, a compliance substrate 40 that is formed of a sealing film 41 and a fixed plate 42 (see FIG. 5) is bonded. Here, the sealing film 41 is formed of a material having low rigidity and flexibility (for example, a polyphenylene sulfide (PPS) film). One side of the reservoir portion 31 is sealed by the sealing film 41. In addition, the fixed plate 42 is formed of a hard material (for example, stainless steel (SUS) or the like) such as metal. An area of the fixed plate 42 that faces the reservoir 100 becomes an opening portion 43 acquired by completely eliminating a portion of the fixed plate 42 in the thickness direction, and accordingly, one side of the reservoir 100 is sealed only by the sealing film 41 having flexibility.

In addition, on the compliance substrate 40, the head case 110 is disposed. In the head case 110, an ink introduction path 111 that is communicated with the ink introduction opening 44 and supplies ink to the reservoir 100 from a storage unit such as a cartridge is disposed.

In addition, in an area of the head case 110 that faces the opening portion 43, a concave portion 112 (see FIG. 5) is formed such that bending deformation of the opening portion 43 is made appropriately. In addition, in the head case 110, a wiring member holding hole 113 that is communicated with the through hole 33 that is formed in the protection substrate 30 is disposed. The lower end portion of the COF substrate 410 is connected to the lead electrode 90 in a state in which the COF substrate 410 and the support member 400 pass through the inside of the wiring member holding hole 113. In addition, the COF substrate 410 and the support member 400 that pass through the wiring member holding hole 113 of the head case 110 are bonded to the head case 110 through the adhesive agent 120 (see FIG. 5). Here, the head case 110 and the COF substrate 410 may be bonded to each other through the adhesive agent 120. However, by directly bonding the head case 110 and the support member 400 to each other, the support member 400 can be held in the head case 110 more assuredly. In other words, by bonding the head case 110 and the support member 400 as rigid bodies, a state in which the COF substrate 410 and the lead electrode 90 are assuredly connected to each other can be maintained. Accordingly, any inconvenience of separation of connection between the COF substrate 410 and the lead electrode 90 so as to be disconnected from each other or the like can be prevented. In this embodiment, the holding holes 411 that are formed in the thickness direction at the predetermined intervals are disposed along the direction of installation of the lead electrode 90 are arranged in the COF substrate 410, and the head case 110 and the support member 400 are bonded together through the holding holes 411 by using the adhesive agent 120. Here, in a case where the head case 110 and the support member 400 are directly bonded to each other, it is preferable that the head case 110 and the support member 400 are formed of materials having the equivalent linear expansion coefficient. In addition, according to this embodiment, the head case 110 and the support member 400 are formed of stainless steel. Accordingly, when the recording head 1 is expanded or contracted due to heat, bending or destruction due to a difference of the linear expansion coefficients of the head case 110 and the support member 400 can be prevented. When the head case 110 and the support member 400 are formed of materials having different linear expansion coefficients, the support member 400 presses the flow path forming substrate 10, and whereby a crack may be generated in the flow path forming substrate 10. In addition, it is preferable that the head case 110 and the support member 400 are formed of materials having an approximately same linear expansion coefficient as that of the protection substrate 30 to which these members are fixed.

In such a recording head 1, the COF substrate 410 is disposed so as to protrude to a side opposite to the ink ejecting face on which the nozzle openings 21 are opened.

The head unit I according to this embodiment, as shown in FIGS. 1 and 2, includes a first holding member 500 on the COF substrate 410 side of the recording head 1 and a second holding member 700 on a side opposite to the recording head 1 of the first holding member 500.

In the first holding member 500, a wiring substrate inserting hole 501 that is formed in the thickness direction is formed, and the plurality of recording heads 1 is held on one face of the wiring substrate inserting hole 501. The first holding member 500 holds the plurality of recording heads 1 in the direction of arrangement of the nozzle rows. In this embodiment, the first holding member 500 holds five of the recording heads 1.

In addition, the wiring substrate inserting hole 501 has such a size that the COF substrate 410 and the support member 400 can be inserted into the wiring substrate inserting hole 501 without allowing the recording head 1 to pass through it. In addition, the lower side of the first holding member 500 is bonded to the head case 110 of the recording head 1 through an adhesive agent. Since the plurality of recording heads 1 is held in the first holding member 500, bridge portions 502 that block each space between adjacent recording heads 1 are disposed on a plurality of the wiring substrate inserting holes 501 so as not to allow ink to penetrate to the inside from each space between adjacent recording heads 1. Described in more detail, the bridge portion 502 is disposed only on the recording head 1 side, and a space is partitioned on the upper side (the second holding member 700 side) of the bridge portion 502. Such a bridge portion 502 can be formed by molding the first holding member 500 separately from the second holding member 700 to be described later in detail. In other words, in a case where the first holding member 500 and the second holding member 700 are integrally molded as one member, such a bridge portion 502 cannot be easily formed. In such a case, even when the bridge portion 502 is formed by performing a grinding process or the like, the process becomes complicated, whereby the manufacturing cost thereof becomes high. As described above, by partitioning a space on the upper side of the bridge portion 502 of the wiring substrate inserting hole 501, the connection member 800, to be described later in detail, and the recording head 1 can be connected together within the space.

The second holding member 700 includes a base member 710 that is bonded to a side (a side other than the side to which the wiring substrate inserting hole 501 is opened) of the first holding member 500 that is opposite to the side to which the recording head 1 is bonded, a supply needle holder 720 in which a plurality of supply needles 730 is disposed, and a protection member 740 that covers the second wiring substrate 600.

The base member 710 has one side bonded to the first holding member 500, and the supply needle holder 720 is fixed on a side of the base member 710 that is located opposite to the first holding member 500. In addition, on a first side (a side intersecting the side to which the first holding member 500 and the supply needle holder 720 are fixed) of the base member 710, a wall portion 711 that is erected in the same direction (the direction of erection of the COF substrate 410) as the direction of insertion of the wiring substrate inserting hole 501 is disposed, and the second wiring substrate 600 is fixed to the outer side (in this embodiment, the protection member 740) of the wall portion 711.

On the second wiring substrate 600 that is held by the second holding member 700, electronic components for various driving signals are mounted, and a driving signal is supplied to the recording head 1 through the connection member 800 that is connected to the end portion of the recording head 1 side. In addition, a connector 601 is disposed on a side (upper side) of the second wiring substrate 600 that is located opposite to the end portion to which the connection member 800 is connected. The external wirings such as control cables extending from the control device are electrically connected to the second wiring substrate 600 through the connector 601.

In addition, as shown in FIG. 1, on a side of the partition wall 711 to which the supply needle holder 720 is fixed, a hook-shaped engagement claw 712 that is opened to the side to which the supply needle holder 720 is brought into contact with and a protrusion portion 713 that protrudes towards the engagement claw 712 side, which is disposed in a position facing the engagement claw 712, are arranged. In addition, near the end portion of the base member 710 that is located opposite to the wall portion 711, a supply needle holder fixing hole 714 that is formed in the thickness direction is disposed. The supply needle holder 720 is fixed to the base member 710 by engaging one end side of the supply needle holder 720 with a space between the engagement claw 712 and the protrusion portion 713 and fixing the other end portion of the supply needle holder 720 by using a fixing screw 715 that is inserted through the supply needle holder fixing hole 714.

Here, as shown in FIG. 2, the supply needle holder 720 that configures the second holding portion 700 has a cartridge installing portion 721, to which an ink cartridge serving as a storage unit storing ink therein is installed, on a side opposite to the side fixed to the base member, that is, the upper side in the figure.

In addition, on the bottom face of the supply needle holder 720, a tube-shaped first flow path forming portion 723, in which a plurality of first supply paths 722 having one end opened to the cartridge installing portion 721 and the other end opened to the first holding member 500 side is formed, protrudes.

As shown in FIG. 1, on one end side of the supply needle holder 720, an engaged claw 724 having the front end protruding upward is disposed. By engaging the engaged claw 724 with a space between the engagement claw 712 of the base member 710 and the protrusion portion 713, one end portion of the supply needle holder 720 is fixed to the base member 710. In addition, in the end portion of supply needle holder 720 that is located opposite to the engaged claw 724, a fixing portion 725, inserted into the supply needle holder fixing hole 714 of the base member 710, with which the fixing screw 715 is engaged is disposed. The position of the supply needle holder 720 is determined by inserting the fixing portion 725 into the supply needle holder fixing hole 714 of the base member 710 in a state in which the engaged claw 724 is engaged with the space between the engagement claw 712 of the base member 710 and the protrusion portion 713. Then, the supply needle holder 720 is fixed to the base member 710 by inserting the fixing screw 715 into the supply needle holder fixing hole 714 of the base member 710 from the side opposite to the supply needle holder 720 and screwing the fixing screw 715 to the fixing portion 725 of the supply needle holder 720.

As shown in FIG. 2, to the upper face side of the supply needle holder 720, that is, an opening portion of the first supply path 722 of the cartridge installing portion 721, a plurality of supply needles 730 that is inserted into the ink cartridges is fixed through a filter 731 that is used for eliminating air bubbles or foreign materials inside the ink.

Each of the supply needles 730 has a through hole 732 that is communicated with the first supply path 722. By inserting the supply needle 730 into the ink cartridge, ink inside the ink cartridge is supplied to the first supply path 722 of the supply needle holder 720 through the through hole 732 of the supply needle 730.

In addition, as shown in FIG. 1, the protection member 740 is formed of a plate-shaped member, which is disposed on the outer side of the wall portion 711, having an "L"-shaped cross-section and, as described above, in an area of the protection member 740 that faces the wall portion 711, the second wiring substrate 600 is fixed.

In the protection member 740, by opening the connector 601 side of the second wiring substrate 600, the connector 601 can be connected to the external wirings.

By protecting the second wiring substrate 600 and the connection member 800 by using the protection member 740, it can prevent the second wiring substrate 600, the connection member 800, or the like from being bumped into by an object from the outside or a foreign material such as ink or dust being attached thereto. In addition, by sealing the space in which the connection member 800 and the COF substrate 410 are connected together except for a part of peripheral area of the connector 601 that is located on the upper side, penetration of ink inside can be suppressed. Described in more detail, in the head unit I, ink is ejected from the ink ejecting face that is the lower face in the figure, that is, a face opposite to the connector 601 of the second wiring substrate 600. Accordingly, even when the connector 601 side is opened, ink cannot easily be inserted into the inside. In addition, when the opening located on the periphery of the connector 601 is closed by using a resin or the like, penetration of the ink can be prevented more assuredly. In this embodiment, the plate-shaped protection member 740 is disposed. However, the invention is not limited thereto. Thus, for example, a slit 505, the connection member 800, and the second wiring substrate 600 may be molded with a material such as a resin having the insulation property.

On the other hand, inside the wiring substrate inserting hole 501 of the first holding member 500, a tube-shaped second flow path forming portion 504, in which the second supply path 503 having one end that is communicated with the ink introduction path 111 of the recording head 1 and the other end that is communicated with each first supply path 722 through a supply communication hole 716 disposed in the base member 710 is arranged, is disposed. In other words, the ink supplied from the through hole 732 of the supply needle 730 is supplied to the recording head 1 through the first supply path 722 of the supply needle holder 720, the supply communication hole 716 of the base member 710, and the second supply path 503 of the first holding member 500. In addition, although not particularly shown in the figure, in areas for connecting the flow paths of each member, that is, an area between the supply needle holder 720 and the base member 710, an area between the base member 710 and the first holding member 500, and the like, circular packing formed from elastomer, rubber, or the like is disposed. By this packing, the first supply path 722, the supply communication hole 716, and the second supply path 503 are communicated with one another without incurring any leakage of the flowing ink to the outside thereof.

On the other hand, as shown in FIG. 2, the COF substrate 410 and the support member 400 are inserted into the wiring substrate inserting hole 501 of the first holding member 500, as described above. In addition, on the second holding member 700 side of the first holding member 500, the connection member 800 is disposed.

The connection member 800, for example, is formed of a wiring substrate such as a flexible printed circuit (FPC) board having flexibility and is disposed so as to face the plurality of recording heads 1 as shown in FIG. 2. To this connection member 800, the COF substrate 410 of each recording head is electrically connected. In other words, the connection member 800 is a common member to which the COF substrates 410 of the plurality of recording heads 1 are connected.

The method of connecting the COF substrate 410 and the connection member 800 together is not particularly limited. In this embodiment, the COF substrate 410 and the connection member 800 are connected to each other by melting metal such as solder that is disposed in the connection member 800 or the COF substrate 410 in advance by bending the end portion of the COF substrate 410 to the support member 400 side and heating the bent end portion of the COF substrate 410 and the connection member 800 that are brought into contact with each other. However, the method of connecting the COF substrate 410 and the connection member 800 is not particularly limited thereto. Thus, a method in which an anisotropic conductive material such as an anisotropic conductive film (ACF) or anisotropic conductive paste (ACP) is used may be used.

In addition, on a side face of the first holding member 500 on which the second wiring substrate 600 is held, the slit 505 is disposed, and the connection member 800 extends to the side of the second holding member 700 through this slit 505. Then, the connection member 800 that extends outside through the slit 505 is bent along the wall portion 711 of the second holding member 700, and the end portion thereof is electrically connected to the second wiring substrate 600. As the method of connecting the second wiring substrate 600 and the connection member 800 together, as in the above-described connecting of the COF substrate 410 and the connection member 800, a method of melting metal such as solder, a method using an anisotropic conductive material, or the like may be used.

In addition, in the connection member 800, an insertion hole 801 into which the second flow path forming portion 504 of the first holding member 500 can be inserted is formed. By using the insertion hole 801, the connection member 800 can be disposed inside the wiring substrate inserting hole 501 of the first holding member 500.

As described above, the connection member 800 is connected to the COF substrate 410 of the recording head 1 inside the wiring substrate inserting hole 501 of the first holding member 500, and the connection member 800 that is connected to the COF substrate 410 is connected to the second wiring substrate 600 disposed in the second holding member 700 that is different from the first holding member 500.

In other words, since the first holding member 500 that holds the recording head 1 and the second holding member 700 that holds the second wiring substrate 600 are formed as separate members, the connection member 800 and the COF substrate 410 can be connected to each other in a state in which the recording head 1 and the first holding member 500 are bonded before the first holding member 500 and the second holding member 700 are bonded. Accordingly, the connecting of the COF substrate 410 and the connection member 800 can be easily performed, and connection of the connection member 800 and the second wiring substrate 600 can be easily performed.

In addition, according to the head unit I of this embodiment, the first holding member 500 and the second holding member 700 are formed as separate members, and the connection member 800 and the COF substrate 410 are connected to each other between the first holding member 500 and the second holding member 700. Accordingly, the handling of the connection member 800 can be easily performed, and the plurality of recording heads 1 can be easily connected to one connection member 800. In addition, the head unit I can be miniaturized, and the manufacturing cost thereof can be reduced. When the first holding member 500 and the second holding member 700 are formed integrally, the plurality of recording heads 1 cannot be easily connected to one connection member 800. The reason is that it is substantially difficult to partition a space on the upper side of the bridge portion 502 as described above, and only a space (wiring substrate inserting hole) partitioned for each recording head 1 can be provided, and the connection members corresponding to the number of the plurality of recording heads 1 are needed. When the connection substrate is disposed for each recording head 1, the number of components is increased, whereby incurring high cost. In addition, in a case where the first holding member 500 and the second holding member 700 are integrally formed, when the recording head 1 and the first holding member 500 are bonded together, the recording head 1 and the connection member need to be inserted into the wiring substrate inserting hole 501 in a state in which an individual connection member is connected to each recording head 1. Accordingly, an adhesive agent that is used for bonding the recording head 1 and the first holding member 500 together can be easily attached to the connection substrate or the like, and there is a possibility that a bad connection between the connection member and the wiring substrate due to the superfluous adhesive agent or a bad connection between the recording head 1 and the first holding member 500 due to the insufficient adhesive agent occurs. Also in this embodiment, even when the connection members 800 are disposed for each recording head 1 or a plurality of recording heads 1 as a group, the handling of the connection member 800 can be easily performed. As a result, an advantage that the connection substrate and the COF substrate 410 can be assuredly connected to each other can be acquired.

In the head unit I having the above-described configuration, ink from the ink cartridge is inserted into the reservoir 100 through the through hole 732, the first supply path 722, the supply communication hole 716, the second supply path 503, the ink introduction path 111, and the ink introduction opening 44, and the inside of the flow path from the reservoir 100 to the nozzle opening 21 is filled with the ink. Thereafter, by applying voltages to the piezoelectric elements 300 corresponding to the pressure generating chambers 12 in accordance with a recording signal supplied from the second wiring substrate 600 through the connection member 800 and the COF substrate 410, the vibration plate 23 is transformed to be bent together with the piezoelectric element 300. Accordingly, the pressure inside each pressure generating chamber 12 is increased, and ink droplets are ejected from each nozzle opening 21.

Other Embodiments

Figure 6A:
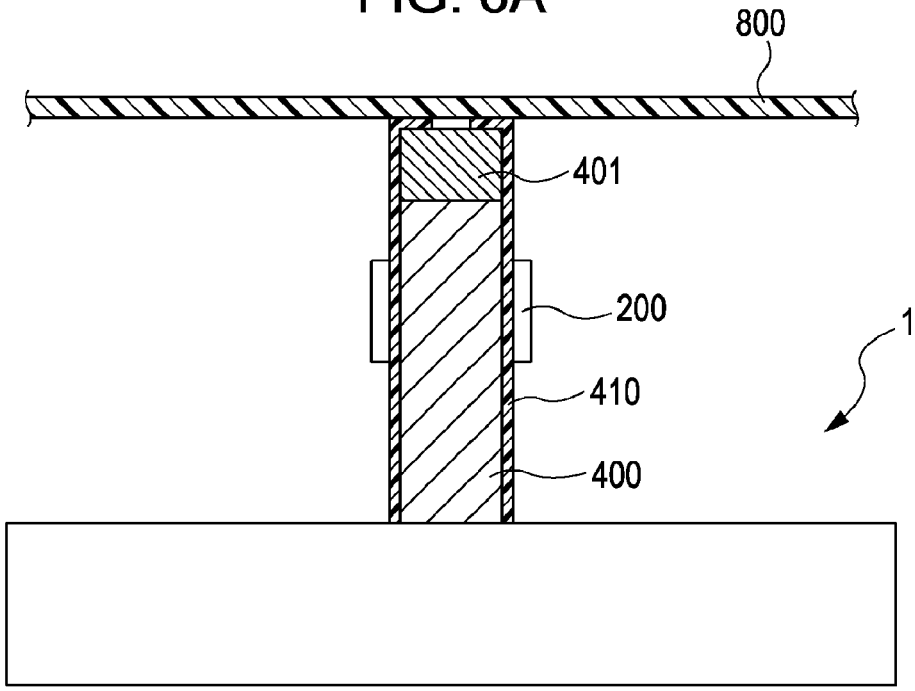
FIGS. 6A and 6B are cross-sectional views showing a modified example of a head unit according to another embodiment of the invention.
Figure 6B:
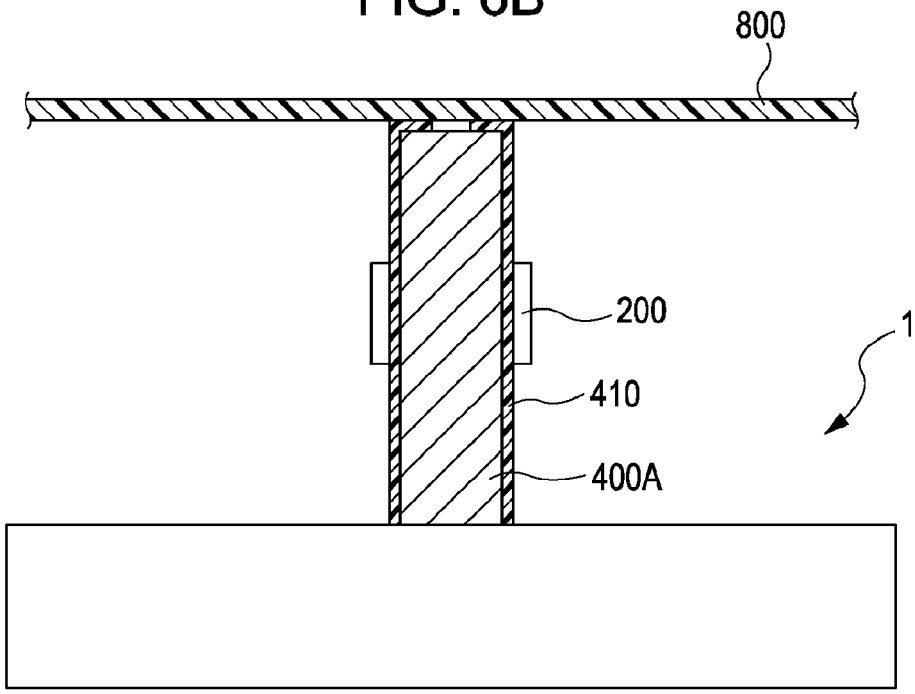

As above, an embodiment of the invention has been described. However, the basic configuration according to an embodiment of the invention is not limited to the above-described embodiment. For example, in the above-described Embodiment 1, the end portion of the COF substrate 410 that is located opposite to the end portion thereof that is connected to the lead electrode 90 is configured to protrude relative to the support member 400, and the protruded end portion of the COF substrate 410 is connected to the connection member 800. However, the invention is not particularly limited thereto. For example, as shown in FIG. 6A, a spacer member 401 may be disposed between the support member 400 and a flexed end portion of the COF substrate 410 that is connected to the connection member 800. By disposing the spacer member 401 as described above, for example, when the side of the connection member 800 that is located opposite to the COF substrate 410 is pressed (heated) by using a heating tool for connecting the COF substrate 410 and the connection member 800 together, the spacer member 401 supports the COF substrate 410 and the rear side of the connection member 800. Accordingly, the COF substrate 410 and the connection member 800 can be connected to each other. The spacer member 401, as shown in FIG. 6B, may be a support member 400A that is formed by integrating the spacer member 401 and the support member 400. In other words, the end portion of the support member 400A that is located on the connection member 800 side is extended, and the COF substrate 410 and the connection member 800 may be connected to each other on the extended cross-section of the support member 400A. However, as shown in FIG. 6A, by forming the spacer member 401 as a body separated from the support member 400, the COF substrate 410 and the lead electrode 90 can be connected together by pressing the cross-section of the support member 400 that is located on the connection member 800 side before disposing the space member 401. Accordingly, the lower position of the support member 400 is pressed, and the fall down of the support member 400 in the direction intersecting the installation direction of the lead electrode 90 is reduced, whereby the connection between the COF substrate 410 and the lead electrode 90 can be made assuredly.

Figure 7A:
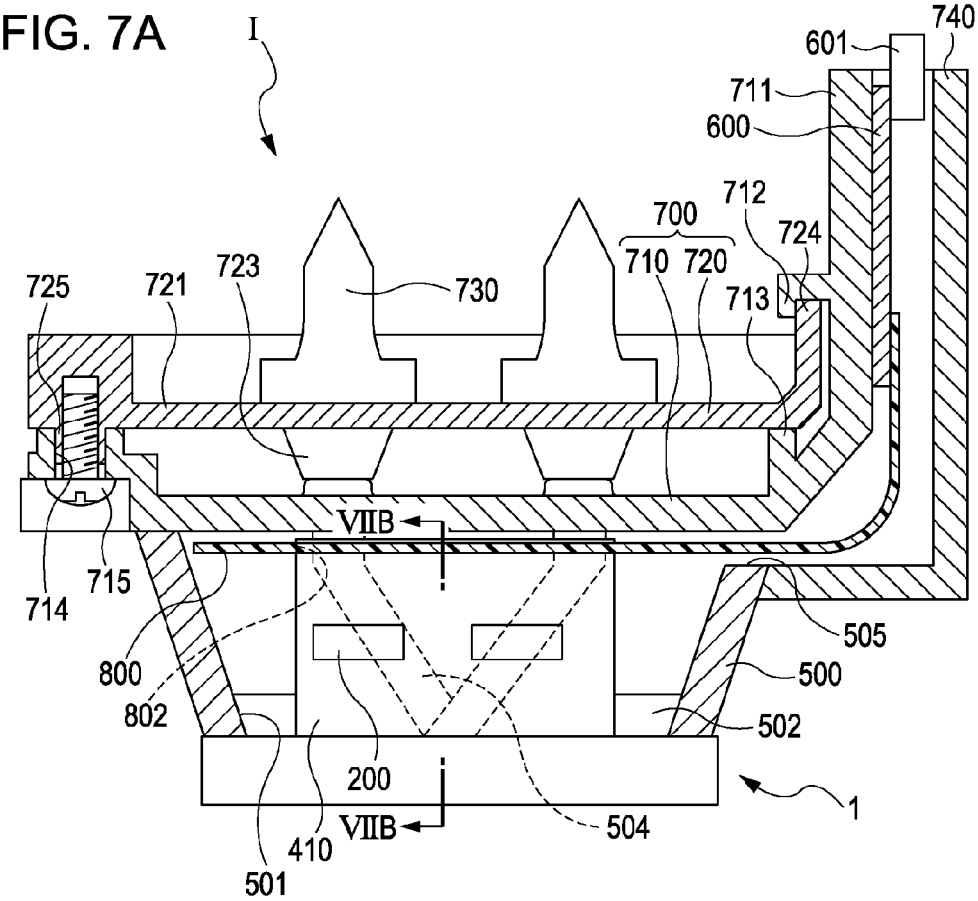
FIGS. 7A and 7B are cross-sectional views showing a modified example of a head unit according to another embodiment.
Figure 7B:
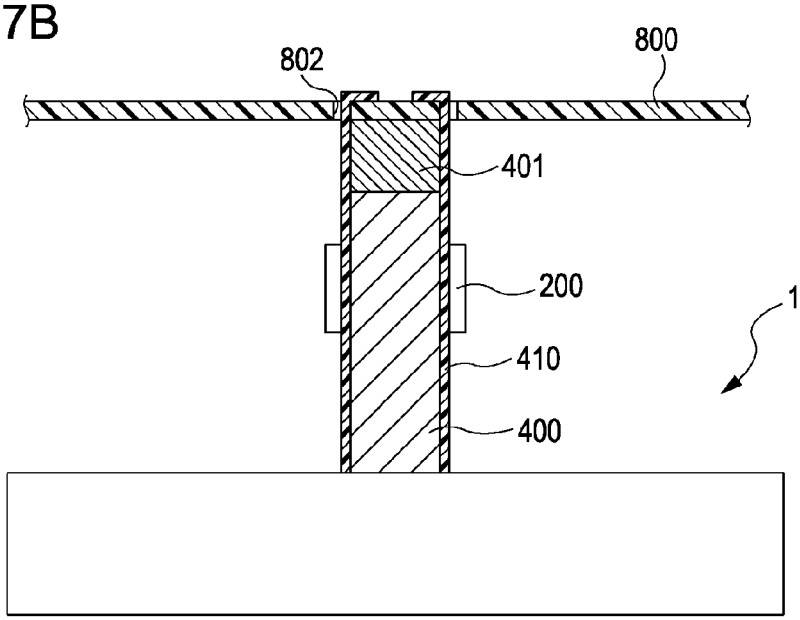

In addition, in the above-described Embodiment 1, the COF substrate 410 is configured to be connected to the recording head 1 side of the connection member 800. However, the invention is not limited thereto. Here, an example in which the COF substrate 410 is connected to the second holding member 700 side of the connection member 800 is shown in FIGS. 7A and 7B. FIG. 7A is a cross-sectional view of the head unit, and FIG. 7B is a cross-sectional view taken along line VIIB-VIIB shown in FIG. 7A.

As shown in FIGS. 7A and 7B, a slit 802 into which the COF substrate 410 is inserted is disposed in the connection member 800, and the flexed end portion of the COF substrate 410 is inserted into the slit 802 so as to be connected to the connection member 800. In other words, it may be configured that a wiring is disposed on a face of the connection member 800 that is located opposite to the recording head 1, and the wiring and the COF substrate 410 are connected together. By using such a configuration, the COF substrate 410 and the connection member 800 can be connected together while the connection state thereof is visually recognized. Accordingly, the operation efficiency can be improved by checking the bad connection or the connection state, and the reliability thereof can be improved. In other words, the COF substrate 410 of the recording head 1 and the connection member 800 are connected together in a state in which the recording head 1 is bonded to the first holding member 500 as described above, and accordingly, it is difficult to visually recognize the connection state when the connection member 800 is connected to the COF substrate 410 on the recording head 1 side of the connection member 800. In addition, in the above-described Embodiment 1 and the example shown in FIGS. 6A and 6B, the face of the connection member 800 to which the COF substrate 410 is connected and the face connected to the second wiring substrate 600 are different from the face located on the second holding member 700 side, and accordingly, the second wiring substrate 600 is fixed to the protection member 740. In the example shown in FIGS. 7A and 7B, since a wiring is disposed on the second holding member 700 side of the connection member 800, the second wiring substrate 600 is fixed to the wall portion 711 of the second holding member 700. In the examples shown in the above-described Embodiment 1 and the example shown in FIGS. 6A and 6B, it is apparent that the second wiring substrate 600 can be fixed to the wall portion 711 of the second holding member 700 by utilizing that wirings are disposed on both faces of the connection member 800. However, since the connection member 800 in which a wiring is disposed on only one face is relatively inexpensive, the manufacturing cost can be reduced by using the second wiring substrate 600 in which a wiring is disposed only on one face.

Figure 8:
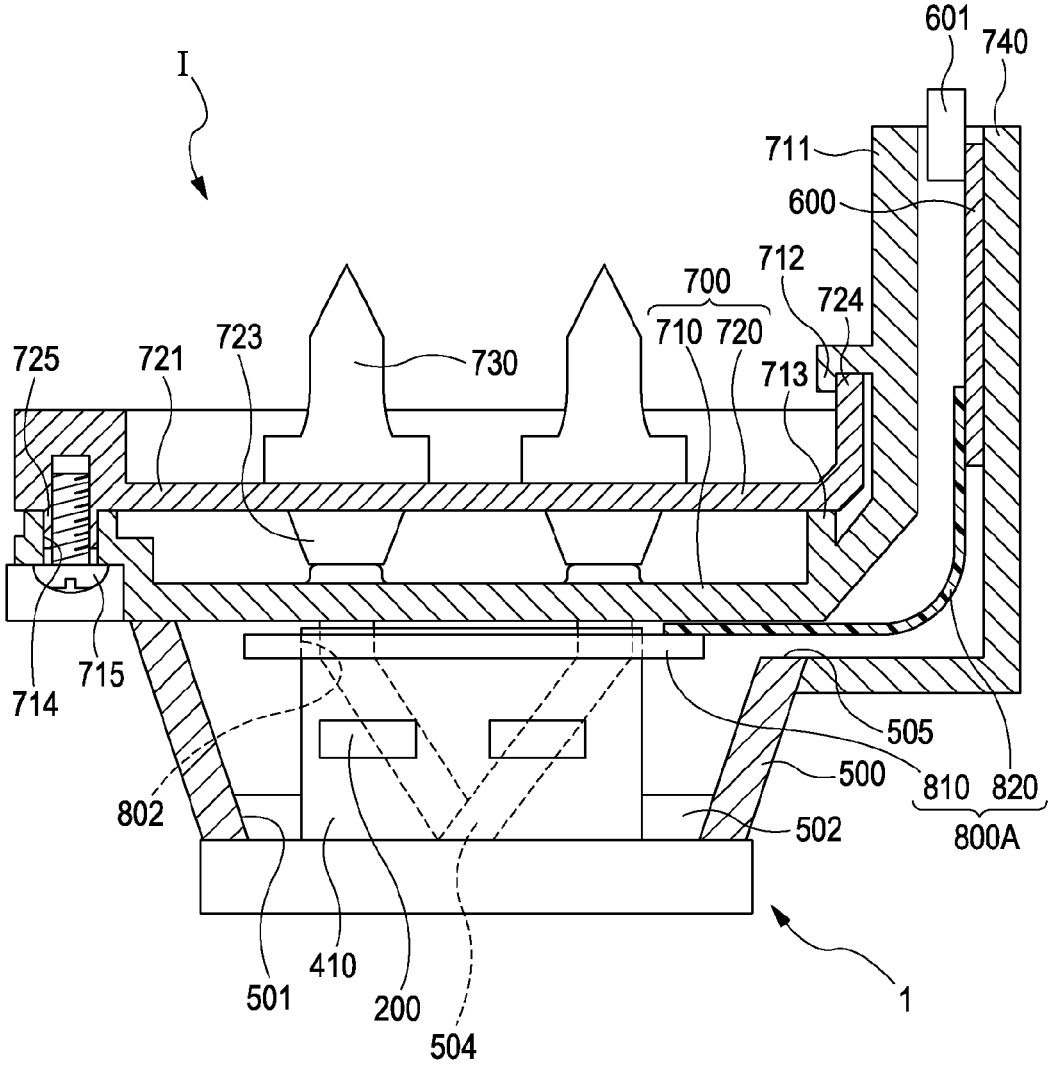
FIG. 8 is a cross-sectional view showing a modified example of a head unit according to another embodiment.

In the above-described example, a flexible printed circuit board has been exemplified as the connection member 800. However, only a flexed portion of the connection member 800 needs to have flexibility. Thus, for example, a rigid-flexible substrate may be used as the connection member 800. In other words, as an example of the rigid-flexible substrate, for example, a configuration in which the second wiring substrate 600 side and the COF substrate 410 side are configured as rigid substrates, and the two rigid substrates are connected together with a flexible substrate may be used. In addition, when the connection member 800 and the COF substrates 410 are connected together by using the method shown in FIGS. 7A and 7B, for example, a configuration as shown in FIG. 8 may be used. In other words, as shown in FIG. 8, a connection member 800A is configured by a rigid substrate 810 to which the COF substrate 410 is connected and a flexible substrate 820 that connects the rigid substrate 810 and the second wiring substrate 600 together.

The rigid substrate 810 has a plate-shape. In the rigid substrate 810, a slit 802 into which the COF substrate 410 is inserted is disposed. Then, the flexed end portion of the COF substrate 410 is inserted into the slit 802 so as to be connected to the connection member 800A.

In addition, the flexible substrate 820 has one end electrically connected to the rigid substrate 810 and the other end electrically connected to the second wiring substrate 600. This flexible substrate 820 is disposed so as to be flexed along the bottom face of the base member 710 and the corners of the wall portion 711. Described in more detail, the second wiring substrate 600 is fixed to the wall portion 711 side.

Even in a case where such a connection member 800A is used, advantages that are the same as those of the above-described Embodiment 1 can be acquired. In addition, generally, the rigid substrate 810 is less expensive than the flexible substrate 820, and accordingly, the manufacturing cost can be reduced further by using the connection member 800A. In addition, since the side of the connection member 800A to which the COF substrate 410 is connected is configured as the rigid substrate 810, a jig that supports the bottom face of the rigid substrate 810 at the time of the connecting of the connection member 800A and the COF substrate 410, the spacer member 401 shown in the above-described FIG. 6A, the extended support member 400A, and the like are not needed. Accordingly, the connection operation can be performed in an easy manner, and the manufacturing cost can be reduced.

In addition, for example, in the above-described Embodiment 1, the COF substrates 410 are disposed on both sides of the support member 400. However, two or more COF substrates 410 may be configured to be disposed on each side.

In addition, in the above-described Embodiment 1, one COF substrate 410 is disposed on each of both sides of the support member 400. However, the invention is not particularly limited thereto. For example, the COF substrate 410 may be configured to be disposed only on one side face of the support member 400, or one continuous COF substrate may be used as the COF substrate 410 disposed on both sides. Furthermore, differently from the above-described configurations, it may be configured that the driving circuit 200 is disposed in a different position, and a wiring substrate other than the COF substrate on which any circuit is not mounted is used.

In addition, in the above-described Embodiment 1, two rows in which the pressure generating chambers 12 are disposed in parallel are arranged on the flow path forming substrate 10. However, in such a case, the number of the rows is not particularly limited. Thus, there may be one, three or more rows. When a plurality of rows is disposed, at least two rows forming one set are disposed to face each other.

In addition, in the above-described Embodiment 1, although an actuator device having a thin-film type piezoelectric element 300 has been described as the pressure generating element that generates a pressure change in the pressure generating chamber 12, however, the invention is not limited thereto. For example, an actuator device of a thick film type that is formed by using a method of attaching a green sheet or the like, an actuator device of a vertical-vibration type that laminates a piezoelectric material and an electrode forming material alternately and expands or contracts the materials in the axis direction, or the like may be used. In addition, a device in which a heating element is disposed inside the pressure generating chamber as the pressure generating element and ink droplets are discharged from a nozzle opening due to bubbles that are generated by heat generation of the heating element, so-called an electrostatic actuator that generates static electricity between a vibration plate and an electrode and discharges ink droplets from a nozzle opening by transforming the vibration plate based on an electrostatic force, or the like may be used.

Figure 9:
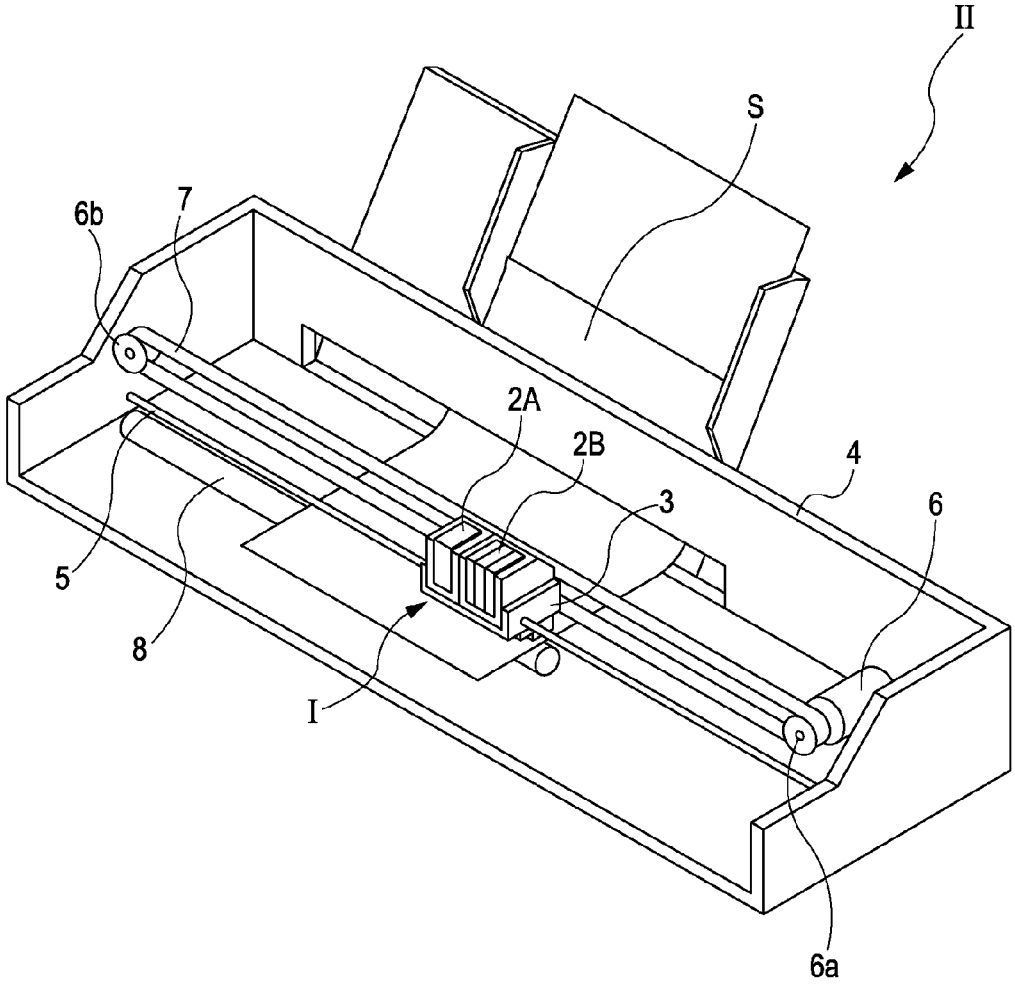
FIG. 9 is a schematic diagram showing an ink jet recording apparatus according to an embodiment of the invention.

In addition, the head unit I of the above-described embodiment is mounted to an ink jet recording apparatus II. FIG. 9 is a schematic diagram showing an example of the ink jet recording device. As shown in the figure, the head unit I of the above-described Embodiment 1 is configured such that cartridges 2A and 2B configuring the ink supplying unit can be detachably attached thereto. In addition, a carriage 3 on which the head unit I is mounted is disposed to a carriage shaft 5, which is installed to a device main body 4, so as to be movable in the shaft direction. This head unit I is configured to eject a black ink composition and a color ink composition.

As a driving force of the driving motor 6 is transferred to the carriage 3 through a plurality of gears and a timing belt 7 that are not shown in the figure, the carriage 3 on which the head unit I is mounted moves along the carriage shaft 5. On the other hand, in the device main body 4, a platen 8 is disposed along the carriage shaft 5, and a recording sheet S as a recording medium such as a paper sheet that is fed by a paper feed roller not shown in the figure or the like is wound around the platen 8 so as to be transported.

In addition, the structure of the flow path and the materials are not limited to the description above.

In addition, in the above-described embodiment, the ink jet recording head as an example of a liquid ejecting head has been described. However, the invention is for the overall liquid ejecting heads in a broad meaning. Thus, the invention may be applied to a liquid ejecting head that ejects liquid other than ink, as well. As other liquid ejecting heads, for example, there are various recording heads that are used for an image recording apparatus such as a printer, a color material ejecting head that is used for manufacturing a color filter of a liquid crystal display or the like, an electrode material ejecting head that is used for forming an electrode of an organic EL display, an FED (field emission display), or the like, and a bioorganic material ejecting head that is used for manufacturing a bio chip.

What is claimed is:

1. A liquid ejecting head unit comprising:

a liquid ejecting head that ejects a liquid;

a first holding member that holds the liquid ejecting head; and a second holding member that is disposed on the first holding member, wherein the liquid ejecting head includes:

a nozzle face on which a nozzle opening for ejecting the liquid is disposed; and a first wiring substrate having flexibility that is disposed to be erected in a direction perpendicular to the nozzle face, wherein the first holding member has a wiring substrate inserting hole in which the first wiring substrate is disposed, holds the liquid ejecting head on one face side on which the wiring substrate inserting hole is opened, and is held by the second holding member on a side opposite to the liquid ejecting head, and wherein, on a side opposite to the liquid ejecting head in the wiring substrate inserting hole, the first wiring substrate of the liquid ejecting head and a connection member that is electrically connected to a second wiring substrate are electrically connected to each other on the first holding member side of the second holding member.

2. The liquid ejecting head unit according to claim 1, wherein the second wiring substrate is disposed in the second holding member, and wherein the second holding member includes a protection member that is used for protecting the second wiring substrate.

3. The liquid ejecting head unit according to claim 1, wherein a plurality of the liquid ejecting heads is held in the first holding member.

4. The liquid ejecting head unit according to claim 3, wherein the first wiring substrate of each of the plurality of the liquid ejecting heads is connected to the common connection member.

5. The liquid ejecting head unit according to claim 1, wherein a connection space in which the first wiring substrate and the connection member are connected together is sealed on the side of the liquid ejecting head.

6. A liquid ejecting apparatus comprising the liquid ejecting head unit according to claim 1.

* * * * *